US009770645B2

(12) United States Patent
Stevens

(10) Patent No.: US 9,770,645 B2
(45) Date of Patent: Sep. 26, 2017

(54) FLEXIBLE LIGHT-WEIGHT SHIN AND ANKLE GUARD PROVIDING COMPREHENSIVE PROTECTION AGAINST LOWER LEG INJURY WHILE PROVIDING FULL RANGE OF MOTION

(71) Applicant: Brett Andrew Stevens, Sandpoint, ID (US)

(72) Inventor: Brett Andrew Stevens, Sandpoint, ID (US)

( * ) Notice: Subject to any disclaimer, the term of this patent is extended or adjusted under 35 U.S.C. 154(b) by 101 days.

(21) Appl. No.: 14/604,668

(22) Filed: Jan. 23, 2015

(65) Prior Publication Data

US 2015/0202520 A1 Jul. 23, 2015

Related U.S. Application Data

(60) Provisional application No. 61/930,686, filed on Jan. 23, 2014.

(51) Int. Cl.

| | |
|---|---|
| ***A41D 13/06*** | (2006.01) |
| ***A63B 71/12*** | (2006.01) |
| ***A41D 13/05*** | (2006.01) |

(52) U.S. Cl.

CPC ..... *A63B 71/1225* (2013.01); *A41D 13/0543* (2013.01); *A41D 13/0562* (2013.01); *A63B 2071/1258* (2013.01); *A63B 2071/1275* (2013.01); *A63B 2209/10* (2013.01)

(58) Field of Classification Search

CPC ..... A41D 13/06; A61F 5/00; A63B 71/1225; A63B 2071/1258; A63B 2071/1275

USPC ..... 2/22

See application file for complete search history.

(56) References Cited

U.S. PATENT DOCUMENTS

| | | | |
|---|---|---|---|
| 2,563,763 | A | 8/1951 | Vietas |
| 2,918,734 | A | 12/1959 | Hyde |
| 3,327,410 | A | 6/1967 | Park, Sr. et al. |
| 3,534,957 | A | 10/1970 | Norman et al. |

(Continued)

OTHER PUBLICATIONS

Sports Unlimited Inc., Nike STR8 Jacket Football Cleat Brace System, Website Link: http://www.sportsunlimitedinc.com/nike-str8-jacket.html, Dec. 10, 2014.

(Continued)

*Primary Examiner* — Katherine Moran

(74) *Attorney, Agent, or Firm* — Russ Weinzimmer & Associates, PC

(57) ABSTRACT

A lower leg guard device is disclosed allowing a full range of ankle motion, while at the same time preventing impact injuries to the lower leg, including the Achilles area, the ankle, and the shin. The lower leg guard device includes two substantially rigid exterior shells each with a cushioned interior liner. The lower leg guard device can be securely attached to the lower leg with one or more attachment straps, and with at least one floating attachment pad that attaches to the wearer's footwear. A floating attachment pad can be positioned over both the inner side and outer side of the ankle, preferably attached to footwear that covers the ankle. The floating attachment pads are attached to the footwear using removable fasteners, located on the exterior surface of the footwear worn by the wearer, so that the guard device can be quickly and easily put on and removed.

17 Claims, 6 Drawing Sheets

(56) References Cited

U.S. PATENT DOCUMENTS 4,139,002 A * 2/1979 Almedia ..... A61F 5/0125 2/22
4,280,489 A 7/1981 Johnson, Jr.
4,411,077 A 10/1983 Slavitt
4,489,719 A 12/1984 Lapenskie
4,556,054 A 12/1985 Paulseth
4,566,209 A 1/1986 Johnson
4,621,648 A 11/1986 Ivany
4,876,745 A * 10/1989 Richards ..... A41D 13/065 2/24
4,922,630 A 5/1990 Robinson
4,960,135 A 10/1990 Nelson
4,982,733 A 1/1991 Broadhurst et al.
5,301,370 A * 4/1994 Henson ..... A63B 71/1225 2/22
5,400,529 A 3/1995 Bell et al.
5,507,720 A * 4/1996 Lampropoulos ..... A61F 5/0111 2/22
5,795,316 A 8/1998 Gaylord
5,833,640 A 11/1998 Vazquez, Jr. et al.
5,868,693 A 2/1999 Duback et al.
5,902,259 A 5/1999 Wilkerson
6,270,468 B1 8/2001 Townsend et al.
6,299,587 B1 * 10/2001 Birmingham ..... A61F 5/0127 602/23
6,350,246 B1 2/2002 DeToro et al.
6,427,239 B1 * 8/2002 Worden ..... A41D 13/065 2/22
6,540,705 B2 4/2003 Norstrem et al.
6,692,454 B1 2/2004 Townsend et al.
2010/0036304 A1 2/2010 Norton
2013/0051264 A1 2/2013 Wang et al.

OTHER PUBLICATIONS

Dick's Sporting Goods, Cramer Active Ankle Volt Brace, Website Link: http://www.dickssportinggoods.com/product/index.jsp-?productId=8359844&cp=4406646.4413887.4414024.4415110, Dec. 10, 2014.
Dick's Sporting Goods, Shock Doctor Ultra Gel Lace Ankle Support, Website Link: http://www,dickssportinggoods.com/product/index.jsp?productId=11584720&clickid=prod_cs &recid=Procuct_PageElement_product_rr_2_966, Dec. 10, 2104.
Ektio, Ektio Black Alexia Ankle Support Basketball Shoes, Website Link: http://www.ektio.com/, Dec. 10, 2014.
PSB Sports Braces, Ankle Brace, Website Link: http://psb.eu/braces/ankle-brace, Dec. 10, 2014.

* cited by examiner

FLEXIBLE LIGHT-WEIGHT SHIN AND ANKLE GUARD PROVIDING COMPREHENSIVE PROTECTION AGAINST LOWER LEG INJURY WHILE PROVIDING FULL RANGE OF MOTION

CROSS-REFERENCE TO RELATED APPLICATIONS

This application derives priority from Provisional patent application Ser. No. 61/930,686 filed Jan. 23, 2014, herein incorporated by reference in its entirety.

FIELD OF THE INVENTION

The present invention relates generally to personal impact protection equipment, and more particularly to lower leg protection equipment.

BACKGROUND OF THE INVENTION

Contact sports, such as American tackle football and lacrosse, are associated with an increased risk of injury to the lower leg of the athletes participating in these dangerous activities. In particular, the Achilles heel and ankle areas are left exposed, and are consequently not protected from the various traumatic hazards associated with those sports. Athletes know that these areas are prone to injury, and often therefore hold back and don't play to their highest potential so as to avoid injury. Once injured, ankles have a high probability of recurring sprains, and suffer increased joint laxity, resulting in a chronic injury pattern.

Protecting the areas around the ankle and the Achilles heel while not hindering the athlete's range of motion is an elusive goal of sporting equipment manufacturers. Rigid ankle bracing, such as the "aircast" stirrup ankle brace disclosed in Johnson, Jr., U.S. Pat. No. 4,280,489, wherein an orthotic device is disclosed consisting of two outer injection molded plastic shells (commonly referred to as "stirrups") having two inner inflatable air bags/bladders. The shells are positioned against the medial side and the lateral side of the heel, ankle, and lower leg, and are connected with attachment straps positioned above the ankle, which straps are connected to a strap under the heel. Braces such as these severely limit the movement and performance of athletes.

Single hinged devices are also well-known in the prior art. For example, Wilkerson, U.S. Pat. No. 5,902,259 discloses a medial hinged stirrup device. This device has a medial hinge and a lateral supporting structure with a lateral malleolar aperture. These devices are bulky, and inhibit an athlete's ability to fully rotate their ankles.

SUMMARY OF THE INVENTION

The present invention is a lower leg, ankle, and Achilles injury protection device that allows a full range of motion of the ankle, while preventing impact injuries to the shin, ankle, and Achilles area. The device includes two substantially rigid exterior shells each with a cushioned interior liner. The device is configured to substantially enclose the lower leg, including the ankle and the Achilles area, and is secured with one or more attachment straps. Two floating attachment pads are incorporated in the lower portion of the device, and are configured to be substantially positioned over the medial side and the lateral side of each ankle, preferably over footwear that covers the ankle. The floating attachment pads have attachment means, such as Velcro® brand hook and loop fastener material, that are configured to attach to complimentary fasteners affixed to exterior surfaces of the footwear worn by the wearer.

For example, each attachment pad has a layer of hook material facing the shoe worn by the person, and the shoe has a layer of loop material bonded to the shoe so that it can engage with the hook material that is bonded to the corresponding floating attachment pad. In this way, the ankle is allowed to flex throughout its entire range of motion, while being protected both from the front and from behind by a hard shell that must remain snug against the forward-facing shin and the rear-facing Achilles areas, respectively, thereby providing reliably constant impact protection to those vulnerable areas.

In preferred embodiments, the floating attachment pads are secured to the protective shell of the device via a stem that extends substantially perpendicularly from the floating attachment pad, and extends through an aperture located on the lower portion of the guard that has a larger diameter than the stem. A retainer, which exceeds the diameter of the aperture, may be positioned on the distal end of the stem and prevents the distal end of the stem from exiting the aperture. The floating attachment pads enable the lower leg, ankle, and Achilles guard device to follow the full range of motion of the ankle, while the exterior shell sections protect the lower leg, ankle, and Achilles area from contact injuries in a variety of positions and stances.

An important psychological benefit of the device of the invention is reduced anxiety about injury to the vulnerable lower leg areas, including the ankle, shin, and Achilles tendon. Being more confident that these vulnerable areas are protected can dramatically enhance the physical performance of a person involved in contact sports, construction, military combat, logging, or other hazardous activity. Further, with reduced fear of injury, a person wearing the protective device of the invention can become more assertive or aggressive when competing during typically dangerous contact sports.

A general aspect of the invention is a shin, ankle, and Achilles guard device for protecting a lower leg of a wearer against impact injury. The guard device includes: a shin protector, having an impact-resistant outer shell and a cushioned inner liner, the shin protector being configured to cover a shin portion of the lower leg of a wearer; an Achilles protector, having an impact-resistant outer shell, and a cushioned inner liner, the Achilles protector being configured to cover an Achilles portion of the lower leg of a wearer; at least one attachment strap capable of urging the shin protector and the Achilles protector together so as to securely attach the shin protector and the Achilles protector to the lower leg of the wearer; and at least one floating attachment pad having a multi-axis adaptable linkage that is attached to the Achilles protector, the multi-axis adaptable linkage allowing a full range of motion of the ankle of the lower leg of the wearer, the floating attachment pad also being adapted to be securely attached to the footwear worn by the wearer throughout the full range of motion, the multi-axis adaptable linkage also preventing the guard device from substantially migrating downward or upward along the lower leg.

In some embodiments, the multi-axis adaptable linkage is a multi-axis rotational linkage, such as a ball joint.

In some embodiments, the multi-axis adaptable linkage is a twistable, bendable, and stretchable linkage, such as a silicone member or rubber member or a neoprene member.

In some embodiments, the Achilles protector is also configured to cover both side-facing malleolar portions of the ankle of the wearer.

In some embodiments, the guard device further includes a strap attached to the Achilles protector capable of more securely attaching the Achilles protector to the footwear of the wearer.

In some embodiments, the floating attachment pad is securely attached to the footwear worn by the wearer throughout the full range of motion using a hook and loop attachment device, wherein the hook material is bonded with one of the footwear and the floating attachment pad, and the loop material is bonded with the other one of the footwear and the floating attachment pad.

In some embodiments, the impact-resistant outer shell of the shin protector and the Achilles protector incorporates a bullet-resistant material, such as Kevlar®.

In some embodiments, the a multi-axis adaptable linkage includes:

a rigid shaft attached at a first end perpendicularly to the floating attachment pad, and attached at a second end perpendicularly to the center of a round flexible disk integral with the Achilles protector, so that the rigid shaft can move with the foot of the wearer, and the Achilles protector can move with the lower leg of the wearer.

In some embodiments, the a multi-axis adaptable linkage includes:

a flexible shaft attached at a first end perpendicularly to the floating attachment pad, and attached at a second end perpendicularly to the Achilles protector, so that the flexible shaft can move with the foot of the wearer, and the Achilles protector can move with the lower leg of the wearer.

Another general aspect of the invention is a shin, ankle, and Achilles guard device for protecting a lower leg of a wearer against impact injury, where the guard device includes: a shin protector, having an impact-resistant outer shell and a cushioned inner liner, the shin protector being configured to cover a shin portion of the lower leg of a wearer; an Achilles protector, having an impact-resistant outer shell, and a cushioned inner liner, the Achilles protector being configured to cover an Achilles portion of the lower leg of a wearer; at least one attachment strap capable of urging the shin protector and the Achilles protector together so as to securely attach the shin protector and the Achilles protector to the lower leg of the wearer; and at least one floating attachment pad having a multi-axis adaptable linkage that is attached to the Achilles protector and to the footwear worn by the wearer, the multi-axis adaptable linkage being a twistable, bendable, and stretchable linkage, the multi-axis adaptable linkage allowing a full range of motion of the ankle of the lower leg of the wearer, the multi-axis adaptable linkage also preventing the guard device from substantially migrating downward or upward along the lower leg.

In some embodiments, the twistable, bendable, and stretchable linkage is made from one of: silicone, rubber, or neoprene.

In some embodiments, the Achilles protector is also configured to cover both side-facing malleolar portions of the ankle of the wearer.

In some embodiments, the guard device further includes a strap attached to the Achilles protector capable of more securely attaching the Achilles protector to the footwear of the wearer.

In some embodiments, the floating attachment pad is securely attached to the footwear worn by the wearer throughout the full range of motion using a hook and loop attachment device, wherein the hook material is bonded with one of the footwear and the floating attachment pad, and the loop material is bonded with the other one of the footwear and the floating attachment pad.

In some embodiments, the impact-resistant outer shell of the shin protector and the Achilles protector incorporates a bullet-resistant material, such as Kevlar®.

In some embodiments, the a multi-axis adaptable linkage includes: a rigid shaft attached at a first end perpendicularly to the floating attachment pad, and attached at a second end perpendicularly to the center of a round flexible disk integral with the Achilles protector, so that the rigid shaft can move substantially with the foot of the wearer, and the Achilles protector can move substantially with the lower leg of the wearer.

In some embodiments, the a multi-axis adaptable linkage includes: a flexible shaft attached at a first end perpendicularly to the floating attachment pad, and attached at a second end perpendicularly to the Achilles protector, so that the flexible shaft can move with the foot of the wearer, and the Achilles protector can move with the lower leg of the wearer.

BRIEF DESCRIPTION OF THE DRAWINGS

The invention will be more fully understood from the following Detailed Description, in conjunction with the following figures, wherein.

DETAILED DESCRIPTION

Figure 1:
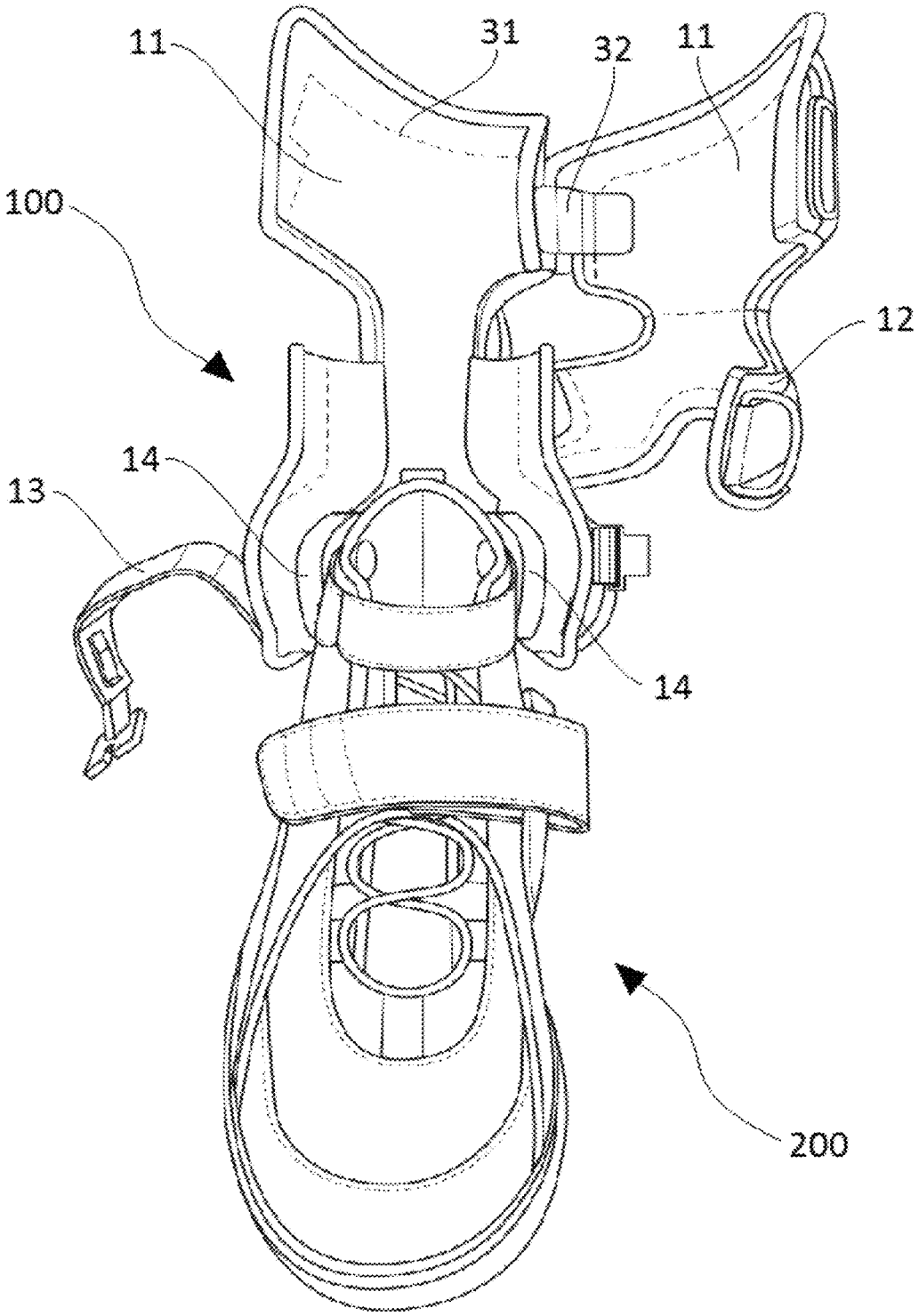
FIG. 1 is a front perspective view of a lower leg and ankle bracing device positioned over an article of footwear according to various embodiments of the present invention.

Referring to FIG. 1, a front perspective view of a lower leg, ankle, and Achilles guard device 100 (sometimes called the "device") is shown positioned over an article of footwear 200 according to various embodiments of the present invention. As used herein the term article of footwear 200 shall preferably mean any type of shoe or boot typically worn by a person during an athletic event, construction work, military activity, or other demanding or hazardous pursuit. In some embodiments, an article of footwear 200 shall mean an athletic shoe, such as American football cleats. In this embodiment shown by FIG. 1, the device 100 generally includes a cushioned liner 11, an exterior shell 12, an attachment strap 13, and two floating attachment pads 14 on the inner and outer side of the wearers ankle.

The device 100 is configured to be positioned over the lower leg and preferably positioned so that the two floating attachment pads 14 are positioned over the exterior surface of an article of footwear 200 with one floating attachment pad 14 substantially positioned over the medial side of the ankle and one floating attachment pad 14 substantially positioned over the lateral side of the ankle.

The cushioned liner 11 is configured to insulate the exterior shell 12 from the lower leg from mechanical impact, and may be made from synthetic and/or natural materials including, foam, silicone, rubber, neoprene, fabric, soft plastic, or any suitable material capable of acting as an impact-absorbing cushion. It will be understood that the term "interior", when used to describe the positioning of elements relative to the device 100, will generally refer to areas of the device 100 configured to be worn closest to the body such as areas of the device bounded by the cushioned liner 11. In preferred embodiments, the cushioned liner is made from neoprene foam rubber and may be covered by a breathable fabric such as cotton or nylon.

A rigid exterior shell 12 substantially surrounds the cushioned liner 11 and gives structural support and rigidity to the device. It will be understood that the term "exterior", when used to describe the positioning of elements relative to the device 100, will generally refer to areas of the device 100 configured to be worn furthest to the body such as areas of the device bounded by the exterior shell 12. In preferred embodiments, the rigid exterior shell 12 and cushioned liner 11 may be joined together with a substantially permanent attachment means such as various types of glue, epoxies, other adhesives, and/or stitching 31. In other embodiments, the rigid exterior shell 12 and cushioned liner 11 may be joined together with a temporary attachment means such as snap type fasteners, Velcro type fasteners, laced or tied on fasteners, buckles, clasps, or any other suitable type or combination of temporary fasteners.

Forces from contact blows to the exterior shell 12 are mitigated by the cushioned liner 11 to prevent contact injuries and injurious movement between the lower leg and foot. The exterior shell 12 may be made from rigid or substantially rigid synthetic and natural materials including hard plastics, carbon fiber, aluminum, titanium, various metal alloys, or other suitable materials of similar rigidity and durability.

A layer of Kevlar® can be interposed between the rigid exterior shell 12 and the cushioned liner 11 so as to add ballistic protection against gunfire.

In the embodiment depicted in FIG. 1 and other preferred embodiments, the cushioned liner 11 and exterior shell 12 can include two separate front and rear sections to facilitate putting the device 100 on and off of the lower leg with each section having a cushioned liner 11 joined to an exterior shell 12. These sections may be joined together with one or more flexible attachments 32 such flexible attachments 32 may be made from material such as nylon webbing, cotton webbing, or other similar materials. In other embodiments, the cushioned liner 11 and exterior shell 12 may each be comprised of a single piece of material with a congruently aligned slit, on both the exterior shell 12 and cushioned liner 11, from the top of the device 100 to the bottom to facilitate placing the device 100 on and off of the lower leg. In further embodiments, both the exterior shell 12 and cushioned liner 11 may each be comprised of three or more separate sections each, with two or more sections joined together with one or more flexible attachments 32 or by similar means. In some alternative embodiments, flexible attachments 32 may be made from flexible molded rubber or similar material with fasteners such as Velcro configured to connect the flexible attachments 32 to the device 100.

In this and other preferred embodiments, two floating attachment pads 14 are positioned on the lower portion of the device 100 and are configured to be substantially positioned over the medial side and lateral side of the ankle preferably over an article of footwear 200 that covers the ankle. It will be understood that the term "lower portion", when used to describe the positioning of elements relative to the device 100, will generally refer to areas of the device 100 configured to be worn closer to the foot of the user as opposed to areas configured to be worn closer to the lower leg of the user.

Figure 2:
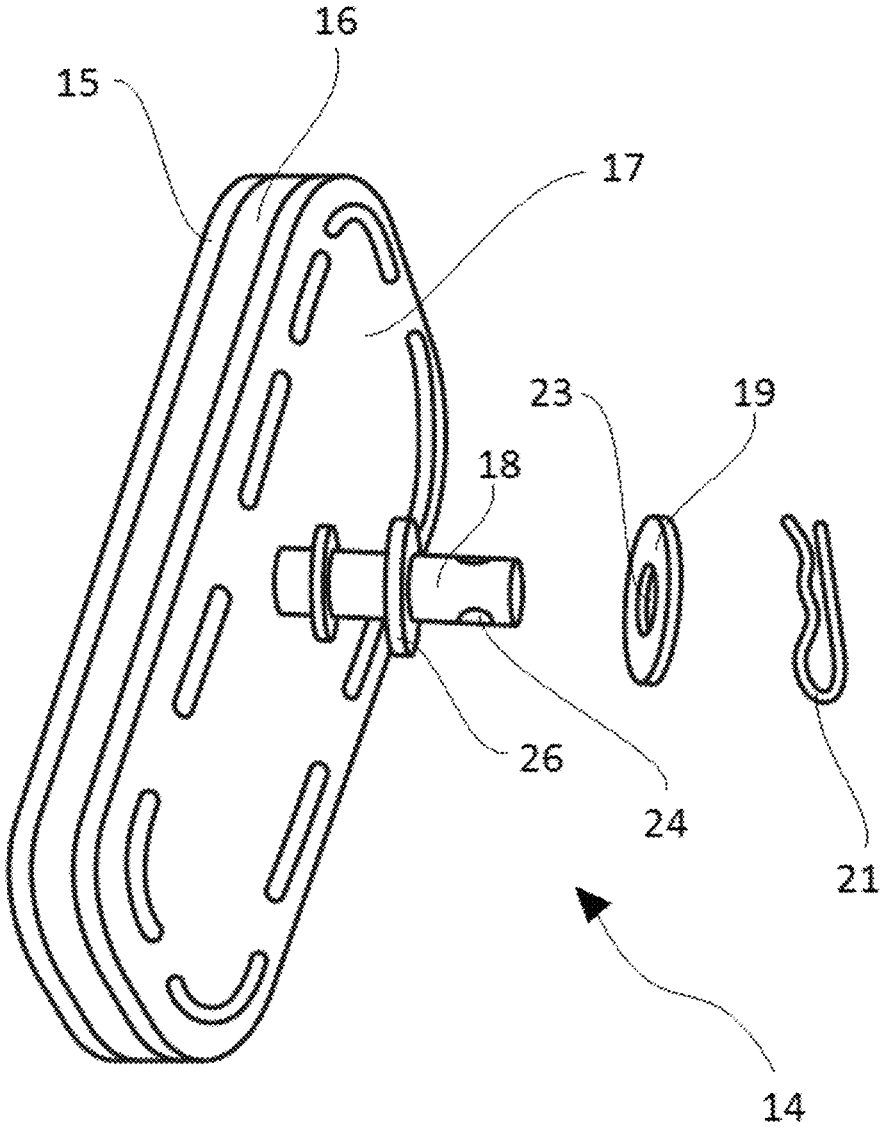
FIG. 2 is an exploded front perspective view of a floating attachment pad according to various embodiments of the present invention.

Referring now to FIG. 2, in preferred embodiments, the floating attachment pads 14 may include an attachment fastener 15, an energy absorbing pad 16, a rigid support element 17, a stem 18, a retainer 19, and a retainer fastener 21. In preferred embodiments, the attachment fastener 15 may include a hook and loop fastener such as Velcro®, and is configured to removably attach to complimentary Velcro® fasteners located on the medial side and lateral side of the ankle on the exterior surface of an article of footwear 200 (FIG. 1) that covers the ankle. In other embodiments, the attachment fastener 15 may include other types of temporary fasteners including snap type fasteners, laced or tied on fasteners, buckles, clasps, or any other suitable type or combination of temporary fasteners. In further embodiments, the attachment fastener 15 may include a substantially permanent type of fastener such as various types of glues, epoxies, chemical welds, or any other suitable type of substantially permanent type of fastener.

In preferred embodiments, an energy absorbing pad 16 may be positioned between the attachment fastener 15 and the rigid support element 17 all of which may be joined together with various types of glues, epoxies, chemical welds, stitching, or any other suitable type of substantially permanent type of fastener. In preferred embodiments, the energy absorbing pad 16 may be made from synthetic and natural materials including, foam, silicone, rubber, neoprene, fabric, soft plastic, or similar material whereby the energy absorbing pad 16 may perform a similar function as the cushioned liner 11 (FIG. 1). In other embodiments, the floating attachment pad 14 may not comprise an energy absorbing pad 16, and instead contain a cushioned liner 11 (FIG. 1) to cushion impacts to the device 100 (FIG. 1), so that the attachment fastener 15 may be joined directly to the rigid support element 17 with various types of glues, epoxies, chemical welds, stitching, or any other suitable type of substantially permanent type of fastener.

The rigid support element 17 may be made from rigid or substantially rigid synthetic and natural materials including hard plastics, carbon fiber, aluminum, titanium, various metal alloys, or other suitable materials of similar rigidity and durability, and it provides structural support and rigidity to the floating attachment pad 14.

In preferred embodiments, one or more stems 18 are positioned on the floating attachment pad 14 such as at the rigid support element 17 and may be made from rigid or substantially rigid synthetic and natural materials including hard plastics, carbon fiber, aluminum, titanium, various metal alloys, or other suitable materials of similar rigidity and durability. In some embodiments, a stem 18 is permanently joined to the rigid support element 17 with various types of glues, epoxies, chemical welds, or any other suitable type of substantially permanent method of joining. In other embodiments, a stem 18 and rigid support element 17 may be integrally formed or molded together in a unitary construction. In further embodiments, a stem 18 may be joined to the rigid support element 17 in a temporary manner such as with male and female threading or any other suitable temporary method allowing the stem 18 and rigid support element 17 to be separated and rejoined as desired.

In preferred embodiments, one stem 18 may be positioned substantially centrally on the side of the rigid support element 17 that is opposite the side containing the attachment fastener 15. In other embodiments, one or more stems 18 may be positioned at any suitable location on the side of the rigid support element 17.

In preferred embodiments, a retainer 19 which may be made from rigid or substantially rigid synthetic and natural materials including hard plastics, carbon fiber, aluminum, titanium, various metal alloys, or other suitable materials of similar rigidity and durability may be positioned on the stem 18 and is configured to maintain the stem 18 in contact with the device 100 and in particular to the exterior shell 12 (FIG. 1) and optionally in contact with the interior liner 11 (FIG. 1). In the embodiment depicted in FIG. 2, the retainer 19 includes a retainer aperture 23, which is configured to receive a portion of the stem 18 and whereby stem 18 may contain a stem aperture 24. Once the retainer 19 is positioned on the stem 18 past the stem aperture 24, a retainer fastener 21 may be inserted into the stem aperture 24 thereby preventing the retainer 19 from separating from the stem 18. In some preferred embodiments, the retainer fastener 21 may include a cotter pin although other fasteners are contemplated including a split pin, a hairpin cotter pin, more commonly known as an "R-clip", a bowtie cotter pin, a circle cotter pin, a rivet type fastener, a threaded fastener, or any other suitable fastener. In some embodiments, the retainer 19 may be permanently joined to the male stem 18 with various types of glues, epoxies, chemical welds, stitching, or any other suitable type of substantially permanent type of fastener or integrally formed into the male stem 18, and the male stem 18 may not comprise a stem aperture 24. In further embodiments, the retainer 19 may be threadedly joined to the stem 18, and the stem 18 may not comprise a stem aperture 24.

In some embodiments, the floating attachment pad 14 achieves its ability to flexibly rotate about in part from the positioning of a bushing 26 on the stem 18. In some embodiments, the bushing 26 is integrally formed into the stem 18. In other embodiments, the bushing 26 may be made from rigid or substantially rigid synthetic and natural materials including hard plastics, carbon fiber, aluminum, titanium, various metal alloys, or other suitable materials of similar rigidity and durability and be permanently joined to the male stem 18 with various types of glues, epoxies, chemical welds, or any other suitable type of substantially permanent method of joining.

Figure 3:
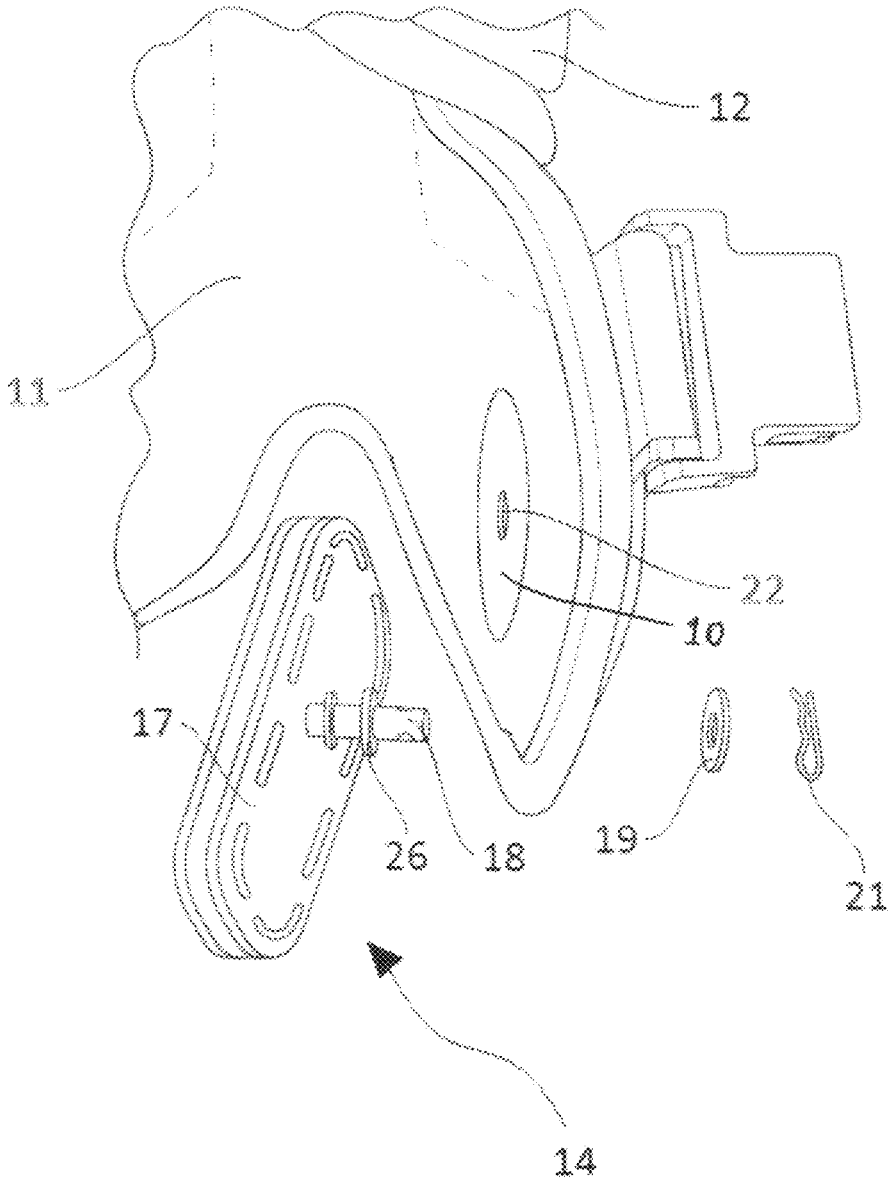
FIG. 3 is a front perspective view of a floating attachment pad and lower portion of a cushioned liner and exterior shell according to various embodiments of the present invention.

Referring now to FIG. 3, one or more floating attachment pads 14 are flexibly attached to the device 100 (FIG. 1) with a stem 18 that extends perpendicularly away from the rigid support element 17 and extends through an aperture 22 in a flexible disk 10 made of suitably durable neoprene, silicone, or rubber, for example, the flexible disk 10 being secured around its periphery to a commensurate hole or convexity in the outer shell 12, and located on the lower portion of the device 100 (FIG. 1), which is configured with a larger diameter than the stem 18. In preferred embodiments, the aperture 22 passes completely through the device 100 (FIG. 1) from the interior to the exterior. A retainer 19 may be positioned on the distal end of the stem 18 and prevents the distal end of the stem 18 from exiting the aperture 22. The interior of the device 100 (FIG. 1) is prevented from contacting the rigid support element 17 by the bushing 26 that is located on the stem 18. The bushing is preferably configured to have a larger diameter than the aperture 22 thereby maintaining a space between the rigid support element 17 and the interior surface of the device 100 (FIG. 1). As mentioned earlier, the flexible rotational ("floating") ability of the floating attachment pads 14 is achieved in part by the ability of the stem 18 to move in the aperture 22 of the flexible disk 10 by approximately the difference in diameter between the stem 18 and the aperture 22 and also by the distance maintained between the rigid support element 17 and the interior of the device 100 (FIG. 1) by the bushing 26.

In some embodiments, the floating ability is due to the flexibility of the flexible disk 10, being able to bend any combination needed of upward and downward, forward and backward, and even accommodate twisting motion.

In some embodiments, the floating ability may be made greater by a greater difference in diameter between the stem 18 and the aperture 22 or also by a greater distance maintained between the rigid support element 17 and the interior of the device 100 (FIG. 1) by the bushing 26. In other embodiments, the floating ability may be reduced by decreasing the difference in diameter between the stem 18 and the aperture 22 or also by a lesser distance maintained between the rigid support element 17 and the interior of the device 100 (FIG. 1) by the bushing 26.

In some alternative embodiments, the floating attachment pad 14 may be flexibly attached to the exterior shell with a ball and socket attachment. A ball joint may be placed at the distal end of the stem 18, away from the rigid support element 17, which will mate and secure to a complimentary shaped socket located in substantially the same location as the aperture 22. In these embodiments, the floating ability may be made greater by increasing the distance between the ball joint and rigid support element 17 or by increasing the ability of the ball to pivot and move within the socket. Conversely, the floating ability may be made lesser by decreasing the distance between the ball joint and rigid support element 17 or by decreasing the ability of the ball to pivot and move within the socket.

The floating ability achieved by the floating attachment pads 14 enables the lower leg and ankle bracing device 100 (FIG. 1) to follow and allow the full range of motion between the foot and the lower leg while the exterior shell 12 and cushioned liner 11 protect the lower leg and ankle, including the Achilles area, from contact injuries.

Figure 4:
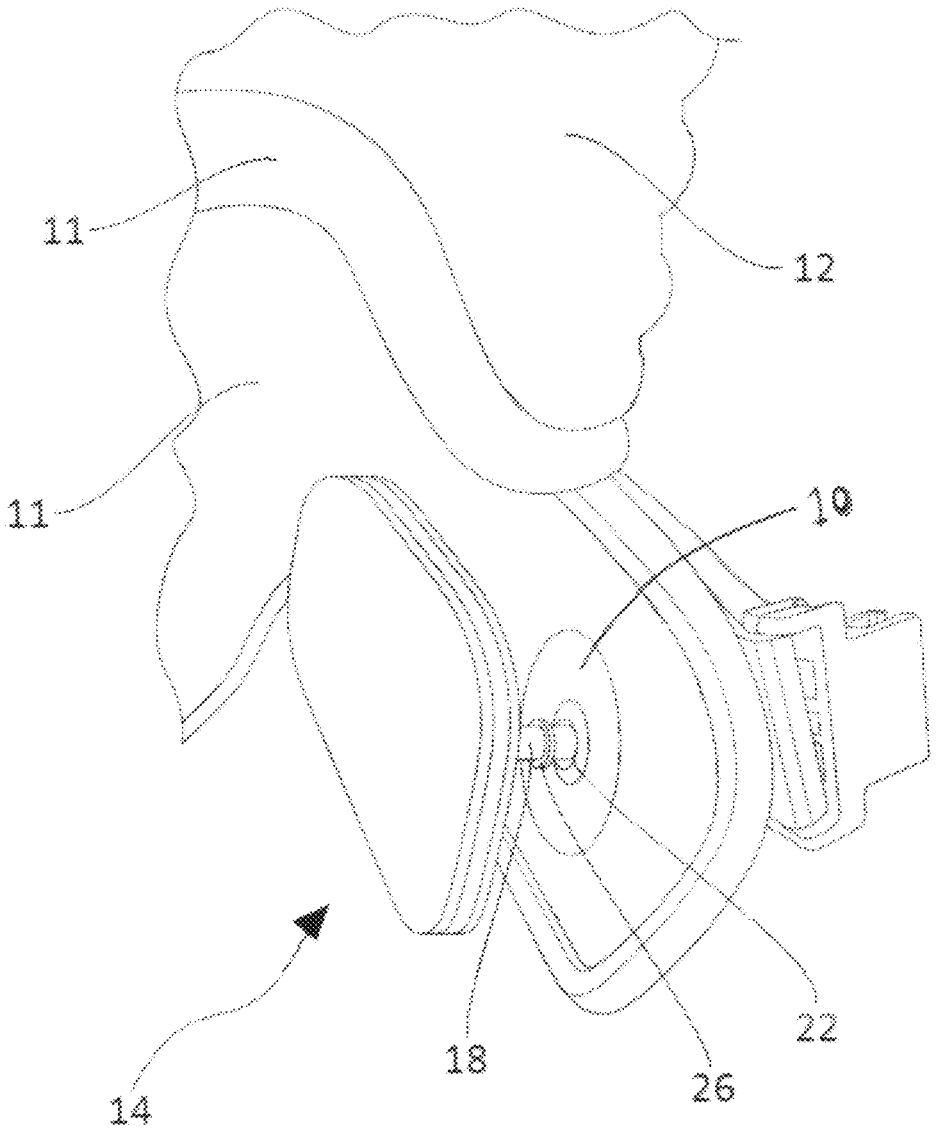
FIG. 4 is a front perspective view of a floating attachment pad mounted to the lower portion of a cushioned liner and exterior shell according to various embodiments of the present invention.

Referring now to FIG. 4, an example of a partial front perspective view of a floating attachment pad 14 mounted to the lower portion of a cushioned liner 11 and exterior shell 12 of a device 100 is provided according to various embodiments of the present invention. In this example, the stem 18 of the floating attachment pad 14 is positioned through the aperture 22 of the flexible disk 10 so that the bushing 26 is positioned on the interior side of the device 100 (FIG. 1) between the device 100 liner 11 and the floating attachment pad 14 and the retainer 19 (FIGS. 2 and 3) is positioned on the exterior side of the device 100 (FIG. 1).

Figure 5:
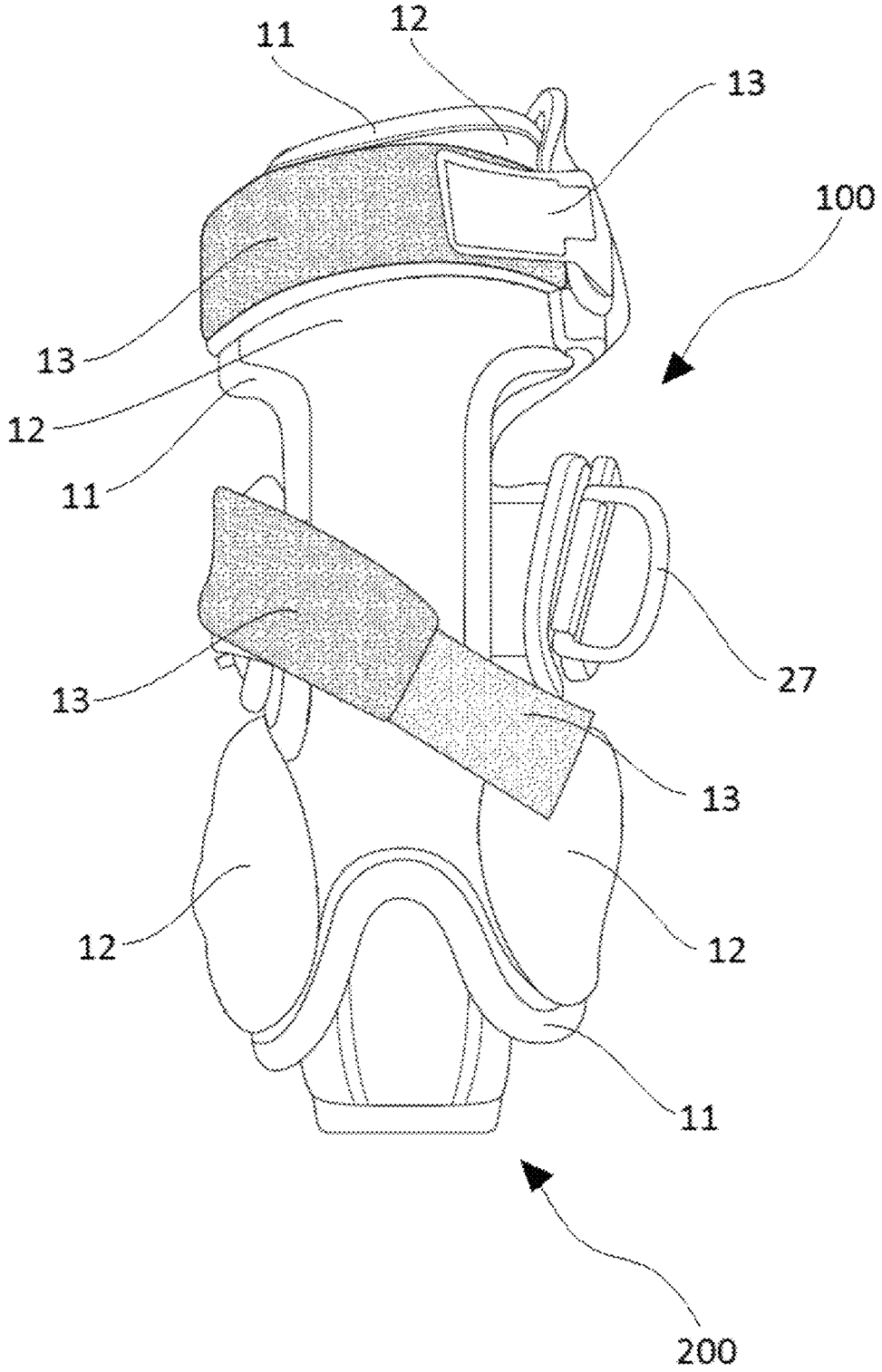
FIG. 5 is a rear view of a lower leg and ankle bracing device positioned over an article of footwear according to various embodiments of the present invention.

FIG. 5 shows a rear profile view of the device 100 positioned over an article of footwear 200 according to various embodiments of the present invention. In preferred embodiments, the device 100 may be secured around the lower leg with one or more attachment straps 13. The attachment straps 13 may be made from natural or synthetic fabrics such as nylon webbing or other similar material, and are configured to attach to a plurality of strap fasteners 27 positioned on the device. Strap fasteners 27 may include Velcro, buttons, male and female snaps, buckles, clasps, or other suitable temporary fastener system. In embodiments where the exterior shell 12 and the cushioned liner 11 are each configured with a congruent slit from the upper portion to the lower portion of the device 100, the attachment straps 13 may be used to secure and substantially join both sides of the slit together. In other embodiments, lacing, buckles, or other similar fastening systems may be used to temporarily secure the device 100 around the lower leg.

Figure 6:
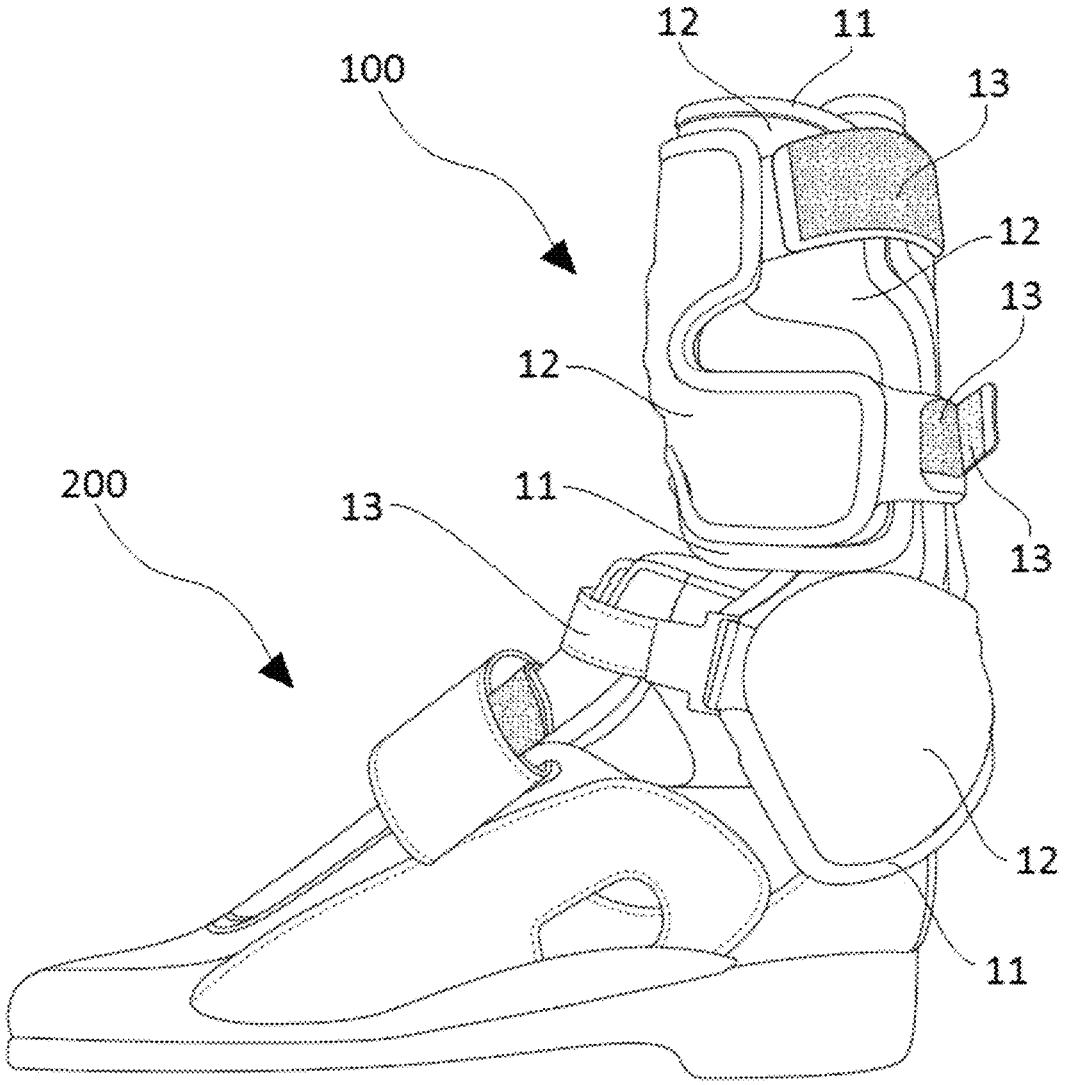
FIG. 6 is a side view of a lower leg and ankle bracing device positioned over an article of footwear according to various embodiments of the present invention.

Referring to FIG. 6, a side profile view of an embodiment of the device 100 is shown, the device 100 being positioned over an article of footwear 200, the lower portion of the device being configured so as to be placed over the upper portion of the article of footwear 200. Three attachment straps 13 are visible and are configured to secure the device 100 to the lower leg of the user and to the upper portion of the article of footwear 200. Also clearly depicted in this illustration, the exterior shell 12 can be seen with the cushioned liner 11 positioned substantially underneath. While the cushioned liner is configured to be positioned closest to the user's lower leg, a portion of the cushioned liner may 11 be positioned over the article of footwear 200. In other embodiments, the device may be used with an article of footwear 200 that does not substantially cover the ankle so that the cushioned liner 11 and the floating attachment pads 14 (FIGS. 1, 2, 3, and 4) contact the ankle and lower leg directly. In embodiments where the device 100 does not overlap the article of footwear 200, the lower portion of the device 100 may attach to the upper portion of an article of footwear 200 with one or more fasteners such as nylon webbing, metal or plastic buckles or clasps, and other suitable fasteners.

Other modifications and implementations will occur to those skilled in the art without departing from the spirit and the scope of the invention as claimed. Accordingly, the above description is not intended to limit the invention, except as indicated in the following claims.

What is claimed is:

1. A shin, ankle, and Achilles guard device for protecting a lower leg of a wearer against impact injury, the wearer also wearing footwear, the guard device comprising:

a shin protector, having an impact-resistant outer shell and a cushioned inner liner, the shin protector being configured to cover a shin portion of the lower leg of the wearer;

an Achilles protector, having an impact-resistant outer shell, and a cushioned inner liner, the Achilles protector being configured to cover an Achilles portion of the lower leg of the wearer;

at least one attachment strap capable of urging the shin protector and the Achilles protector together so as to securely attach the shin protector and the Achilles protector to the lower leg of the wearer; and at least one floating attachment pad having a multi-axis adaptable linkage that is attached to the Achilles protector, the multi-axis adaptable linkage allowing a full range of motion of the ankle of the lower leg of the wearer, the floating attachment pad also being adapted to be securely attached to the footwear worn by the wearer throughout the full range of motion, the multi-axis adaptable linkage also preventing the guard device from substantially migrating downward or upward along the lower leg.

2. The guard device of claim 1, wherein the multi-axis adaptable linkage is a ball joint.

3. The guard device of claim 1, wherein the multi-axis adaptable linkage is one of a: a silicone member or a rubber member or a neoprene member.

4. The guard device of claim 1, wherein the Achilles protector is also configured to cover both side-facing malleolar portions of the ankle of the wearer.

5. The guard device of claim 1, further including a strap attached to the Achilles protector capable of more securely attaching the Achilles protector to the footwear of the wearer.

6. The guard device of claim 1, wherein the floating attachment pad is securely attached to the footwear worn by the wearer throughout the full range of motion using a hook and loop attachment device, wherein the hook material of the hook and loop material attachment device is bonded with one of the footwear and the floating attachment pad, and the loop material of the hook and loop material attachment device is bonded with the other one of the footwear and the floating attachment pad.

7. The guard device of claim 1, wherein the impact-resistant outer shell of the shin protector and the Achilles protector incorporates a bullet-resistant material.

8. The guard device of claim 1, wherein the a multi-axis adaptable linkage includes:

a rigid shaft attached at a first end perpendicularly to the floating attachment pad, and attached at a second end perpendicularly to the center of a round flexible disk integral with the Achilles protector, so that the rigid shaft can move with the foot of the wearer, and the Achilles protector can move with the lower leg of the wearer.

9. The guard device of claim 1, wherein the a multi-axis adaptable linkage includes:

a flexible shaft attached at a first end perpendicularly to the floating attachment pad, and attached at a second end perpendicularly to the Achilles protector, so that the flexible shaft can move with the foot of the wearer, and the Achilles protector can move with the lower leg of the wearer.

10. The guard device of claim 1, wherein the Achilles protector is also configured to cover both side-facing malleolar portions of the ankle of the wearer.

11. The guard device of claim 1, further including a strap attached to the Achilles protector capable of more securely attaching the Achilles protector to the footwear of the wearer.

12. The guard device of claim 1, wherein the floating attachment pad is securely attached to the footwear worn by the wearer throughout the full range of motion using a hook and loop material attachment device, wherein the hook material of the hook and loop material attachment device is bonded with one of the footwear and the floating attachment pad, and the loop material of the hook and loop material attachment device is bonded with the other one of the footwear and the floating attachment pad.

13. The guard device of claim 1, wherein the impact-resistant outer shell of the shin protector and the Achilles protector incorporates a bullet-resistant material.

14. The guard device of claim 1, wherein the multi-axis adaptable linkage includes:

a rigid shaft attached at a first end perpendicularly to the floating attachment pad, and attached at a second end perpendicularly to a center of a round flexible disk integral with the Achilles protector, so that the rigid shaft can move substantially with the foot of the wearer, and the Achilles protector can move substantially with the lower leg of the wearer.

15. The guard device of claim 1, wherein the multi-axis adaptable linkage includes:

a flexible shaft attached at a first end perpendicularly to the floating attachment pad, and attached at a second end perpendicularly to the Achilles protector, so that the flexible shaft can move with the foot of the wearer, and the Achilles protector can move with the lower leg of the wearer.

16. A shin, ankle, and Achilles guard device for protecting a lower leg of a wearer against impact injury, the wearer also wearing footwear, the guard device comprising:

a shin protector, having an impact-resistant outer shell and a cushioned inner liner, the shin protector being configured to cover a shin portion of the lower leg of the wearer;

an Achilles protector, having an impact-resistant outer shell, and a cushioned inner liner, the Achilles protector being configured to cover an Achilles portion of the lower leg of the wearer;

at least one attachment strap, attached to the shin protector and the Achilles protector, the at least one attachment strap being capable of urging the shin protector and the Achilles protector together so as to securely attach the shin protector and the Achilles protector to the lower leg of the wearer; and at least one floating attachment pad having a multi-axis adaptable linkage that is attached to the Achilles protector and to the footwear worn by the wearer, the multi-axis adaptable linkage being a twistable, bendable, and stretchable linkage, the multi-axis adaptable linkage allowing a full range of motion of the ankle of the lower leg of the wearer, the multi-axis adaptable linkage also preventing the guard device from substantially migrating downward or upward along the lower leg.

17. The device of claim 16, wherein the twistable, bendable, and stretchable linkage is made from one of: silicone, rubber, or neoprene.

* * * * *